US012044097B2

(12) United States Patent
Herndon

(10) Patent No.: US 12,044,097 B2
(45) Date of Patent: Jul. 23, 2024

(54) DUAL POSITION ISOLATOR SEAL

(71) Applicant: Weatherford Technology Holdings, LLC, Houston, TX (US)

(72) Inventor: Jeffrey O. Herndon, Bakerfield, CA (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/478,791

(22) Filed: Sep. 29, 2023

(65) Prior Publication Data

US 2024/0026752 A1 Jan. 25, 2024

Related U.S. Application Data

(62) Division of application No. 17/404,775, filed on Aug. 17, 2021, now Pat. No. 11,808,108.

(51) Int. Cl.
*E21B 33/14* (2006.01)
*E21B 23/00* (2006.01)

(52) U.S. Cl.
CPC ..... *E21B 33/14* (2013.01); *E21B 23/00* (2013.01)

(58) Field of Classification Search
CPC ..... E21B 43/103
See application file for complete search history.

(56) References Cited

U.S. PATENT DOCUMENTS 8,826,974 B2 * 9/2014 Lehr ..... E21B 17/14 166/212

OTHER PUBLICATIONS

Internatal Preliminary Report on Patentability, PCT/US2022/035957, dated Feb. 13, 2024, 7 pages.

* cited by examiner

*Primary Examiner* — William D Hutton, Jr.
*Assistant Examiner* — Avi T Skaist
(74) *Attorney, Agent, or Firm* — Peter V Schroeder; Booth Albanesi Schroeder PLLC

(57) ABSTRACT

A wellbore isolation assembly includes an outer component and an inner component. The outer component is disposed at a first location in a wellbore. The inner component is disposed at a second location in the wellbore. The inner component is moved from the second location into engagement with the outer component at the first location to form a barrier within the wellbore. The wellbore isolation assembly is retrievable from the wellbore.

18 Claims, 7 Drawing Sheets

DUAL POSITION ISOLATOR SEAL

CROSS-REFERENCE TO RELATED APPLICATIONS

This application is a divisional application claiming priority to U.S. patent application Ser. No. 17/404,775, filed Aug. 17, 2021, which is incorporated herein by reference in its entirety for all purposes.

BACKGROUND

Field

Embodiments of the present disclosure generally relate to systems and methods for deploying a barrier in a wellbore, and subsequently retrieving the barrier from the wellbore. When deployed in a wellbore, the barrier inhibits passage of fluids.

Description of the Related Art

After a liner has been deployed in a wellbore, sometimes it is desired to set a barrier within the liner. If the liner includes apertures, such as slots and/or a sand control screen, the barrier may be installed in order to fluidically isolate the apertures from another zone in the wellbore. Typically, the installation of the barrier is achieved by running a bridge plug with a setting tool into the wellbore, setting the bridge plug in the liner, or above the liner, and then retrieving the setting tool from the wellbore. Because the running and setting of a liner in a wellbore involves one trip into and out of the wellbore, the installation of the bridge plug requires a dedicated second trip into and out of the wellbore. The second trip, therefore takes time and involves expense over and above the time and expense of running the liner into the wellbore.

Bridge plugs typically include gripping elements, referred to as slips, that bite into the liner in order to anchor the bridge plug to the liner. Hence, the slips damage the interior surface of the liner. The damage caused by the slips can become susceptible to corrosion and/or stress corrosion cracking.

There is a need for improved systems and methods that address the above problems.

SUMMARY

The present disclosure generally relates to systems and methods for deploying a barrier in a wellbore, and subsequently retrieving the barrier from the wellbore. The barrier is formed by mating two components of a wellbore isolation assembly within the wellbore. When deployed in the wellbore, the barrier inhibits passage of fluids.

In one embodiment, a wellbore isolation assembly includes an outer component, an inner component configured to mate with the outer component, and a fastener configured to secure the inner component to the outer component. The outer component includes a mandrel, a seal bore within the mandrel, and a locking dog movable between radially extended and radially retracted positions. The inner component includes a body and a seal element on the body configured to engage the seal bore.

In another embodiment, a method includes disposing an outer component of a wellbore isolation assembly in a first location within a tubular. The method further includes disposing an inner component of the wellbore isolation assembly in a second location within the tubular. The method also includes running the tubular into a wellbore using a work string, then using the work string to move the inner component from the second location to engage with the outer component at the first location. The method includes decoupling the work string from the inner component.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, as the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1:
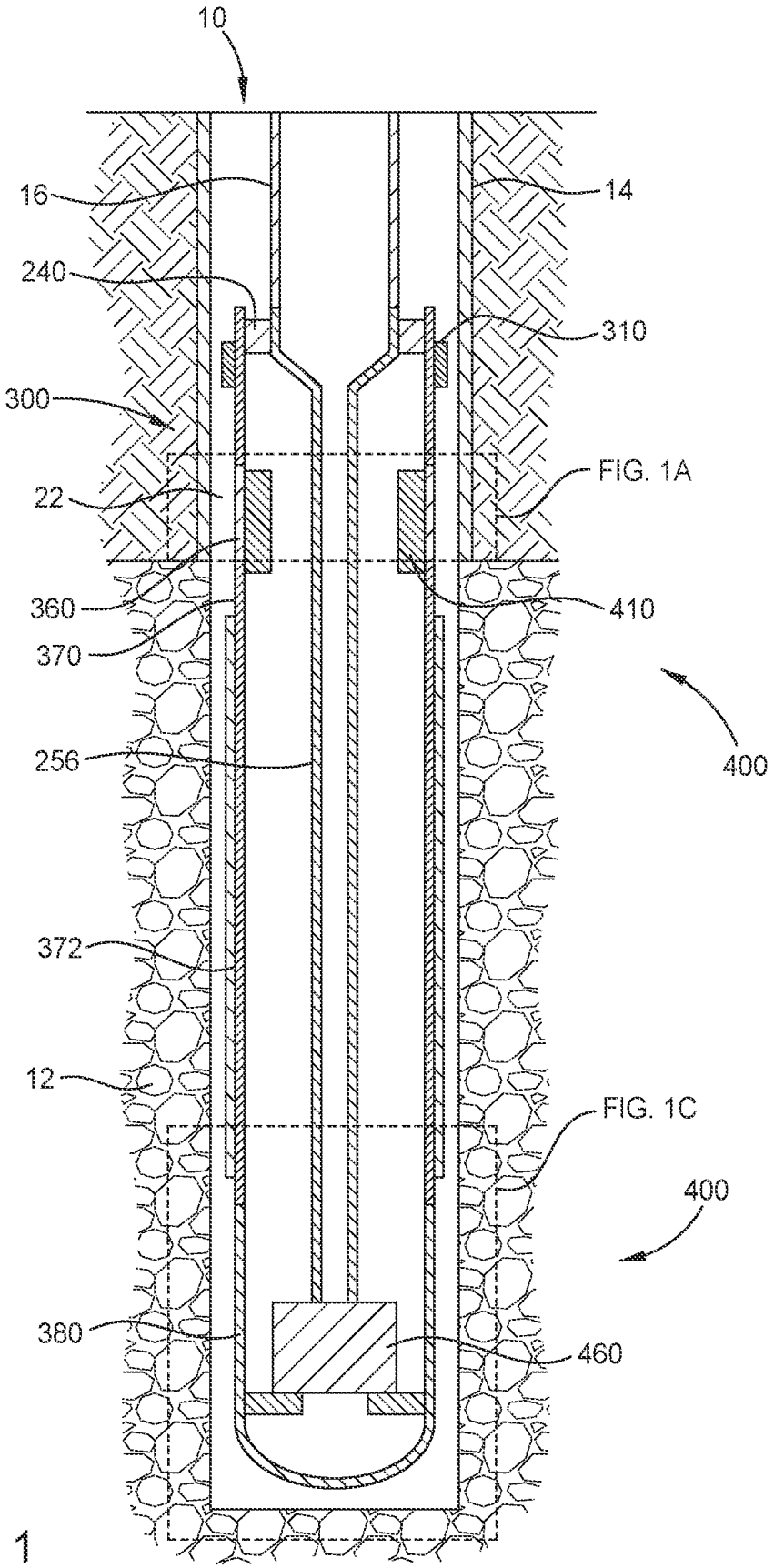
FIG. 1 provides a longitudinal cross-sectional view of a liner assembly incorporating an isolation assembly in a wellbore.

The present disclosure concerns the formation of a barrier within a wellbore, and the subsequent removal of the barrier. When deployed in a wellbore, the barrier inhibits passage of fluids. The systems, assemblies, and methods of the present disclosure can be used for deploying a barrier within a tubular, such as a liner or a casing string, in a wellbore, and subsequently retrieving the barrier from the wellbore. The systems, assemblies, and methods of the present disclosure can be used for a tubular that includes sand control devices, such as slotted liners and screens. The systems, assemblies, and methods of the present disclosure facilitate the deployment of a tubular, such as a liner or a casing string, and the establishment of a barrier within the tubular in a single trip into the wellbore. The systems, assemblies, and methods of the present disclosure facilitate the deployment of a tubular, such as a liner or a casing string, the placement of a cement slurry around the tubular, and the establishment of a barrier within the tubular in a single trip into the wellbore. The systems, assemblies, and methods of the present disclosure facilitate the deployment of a tubular, such as a liner or a casing string, the performance of a gravel packing operation, and the establishment of a barrier within the tubular in a single trip into the wellbore. The systems, assemblies, and methods of the present disclosure facilitate also the removal of the barrier from within the tubular.

The barrier is created by mating together two components of an isolation assembly within the tubular. A first (outer) component of the isolation assembly is disposed in the tubular. The first component includes a mandrel and a throughbore. In some embodiments, it is contemplated that the first component may be installed in the tubular before the tubular is deployed in the wellbore. Alternatively, the first component may be installed in the tubular during or after the tubular is deployed in the wellbore. In embodiments in which the tubular is a liner and a liner hanger and/or a packer is disposed at a top of the liner, the first component is installed at or below the liner hanger/packer. In embodiments in which the tubular includes a tubular joint configured to allow passage of fluid through a wall thereof, such as a tubular joint including an aperture through a wall of the tubular joint, the first component is installed at or above the tubular joint that is configured to allow passage of fluid through a wall thereof.

In some embodiments, the first component is disposed at a portion of the tubular that is adapted to receive the first component. For example, the first component may be disposed at a locator sub of the tubular that includes an inner profile configured to receive, or otherwise engage with, a portion of the first component in order to anchor the first component within the tubular. The locator sub may be a specific joint of the tubular. Alternatively, or additionally, the locator sub may include a coupling of two joints of tubular whereby the inner profile is present between adjacent ends of the coupled tubular joints. The first component makes a sealing contact with an inner wall of the tubular. In an example, the first component makes sealing contact with a seal surface of the locator sub.

A second (inner) component of the isolation assembly is initially separate from the first component, before being moved into the throughbore of the first component and forming a connection with the first component. In some embodiments, it is contemplated that the second component may be installed at a temporary holding location in the tubular before the tubular is deployed in the wellbore. For example, the second component may be installed at a location below the first component, such as at a landing collar and/or at a shoe of the tubular. Alternatively, the second component may be installed in the tubular during or after the tubular is deployed in the wellbore. For example, the second component may be inserted into the tubular as part of the tubular deployment procedure.

The second component is moved at least partially into the first component in order to create the barrier. In some embodiments, it is contemplated that manipulation of a work string coupled to an inner string within the tubular moves the second component into engagement with the first component. A fastener secures the second component to the first component. In some embodiments, the second component makes a sealing contact with the first component. Additionally, or alternatively, the second component may make a sealing contact with the tubular when the second component is engaged with the first component.

When the second component is engaged with the first component and the first component is engaged with the tubular, the isolation assembly provides a barrier within the tubular. The barrier inhibits fluid communication within the tubular between a first zone in the tubular above the isolation assembly and a second zone in the tubular below the isolation assembly.

The isolation assembly can be deployed with a tubular, and configured as the barrier within the tubular during a single trip of a work string into the wellbore. The work string can be removed from the wellbore leaving the isolation assembly in place as a barrier within the tubular. The isolation assembly can be retrieved from the wellbore using a retrieval tool. In some embodiments, it is contemplated that the locator sub is sized such that after retrieval of the isolation assembly from the wellbore, the locator sub permits physical access through the tubular with little to no restriction. For example, a minimum inner diameter of the locator sub may be as much as 85%, as much as 90%, as much as 95%, as much as 97%, or as much as 100% of a drift diameter of the tubular. In some embodiments, the minimum inner diameter of the locator sub may equal an actual inner diameter of the tubular.

In embodiments in which the tubular is a casing string, a casing string along with the isolation assembly may be run into a wellbore, and the casing string may be suspended from a wellhead by a casing hanger. In such embodiments, the casing hanger is used instead of a liner hanger and/or packer described herein with respect to examples in which the tubular is a liner.

In the following description, an isolation assembly is described in the context of installation in, and retrieval from, a liner. It should be understood that the principles apply also to embodiments in which the isolation assembly is deployed, installed within, and retrieved from, any wellbore tubular, such as a tubing string, a riser, a conductor string, a tie-back string, or a casing string.

FIG. 1 provides a longitudinal cross-sectional view of a liner assembly 300 during deployment in a wellbore 10. The wellbore 10 extends into a geological formation 12, and includes a casing 14. As shown, there is no casing within the geological formation 12, however in some embodiments, it is contemplated that the wellbore 10 may include a casing or liner at least partially within the geological formation 12. An annulus 22 exists between the geological formation 12 and the liner assembly 300.

The liner assembly 300 includes a packer 310, a locator sub 360, a liner 370, and a circulating shoe 380. In some embodiments, a liner hanger may be used as well as, or instead of, the packer 310. The locator sub 360 is coupled to liner 370 of the liner assembly 300. In some embodiments, the liner 370 includes a sand control screen 372. The sand control screen 372 includes a tubular configured to allow passage of fluid through a wall thereof, while inhibiting the passage of sand or other particulate matter. For example, the sand control screen 372 may include a slotted liner and/or a woven mesh filter and/or wire wrapping. It is contemplated that the liner 370 may include a plurality of tubulars, such as a plurality of sand control screens 372, connected together.

A first (outer) component of an isolation assembly 400, such as isolator body 410, is coupled to the locator sub 360. A second (inner) component of the isolation assembly 400, such as isolation packer 460, is located at the circulating shoe 380.

The liner assembly 300 is deployed into the wellbore 10 using a work string 16, such as drill pipe, coiled tubing, or another tubular. The liner assembly 300 is coupled to the work string via a liner running sub 240, from which an inner string 256 is suspended within the liner 370. The inner string 256 passes through the isolator body 410, and is coupled to the isolation packer 460 at the circulating shoe 380.

Figure 1A:
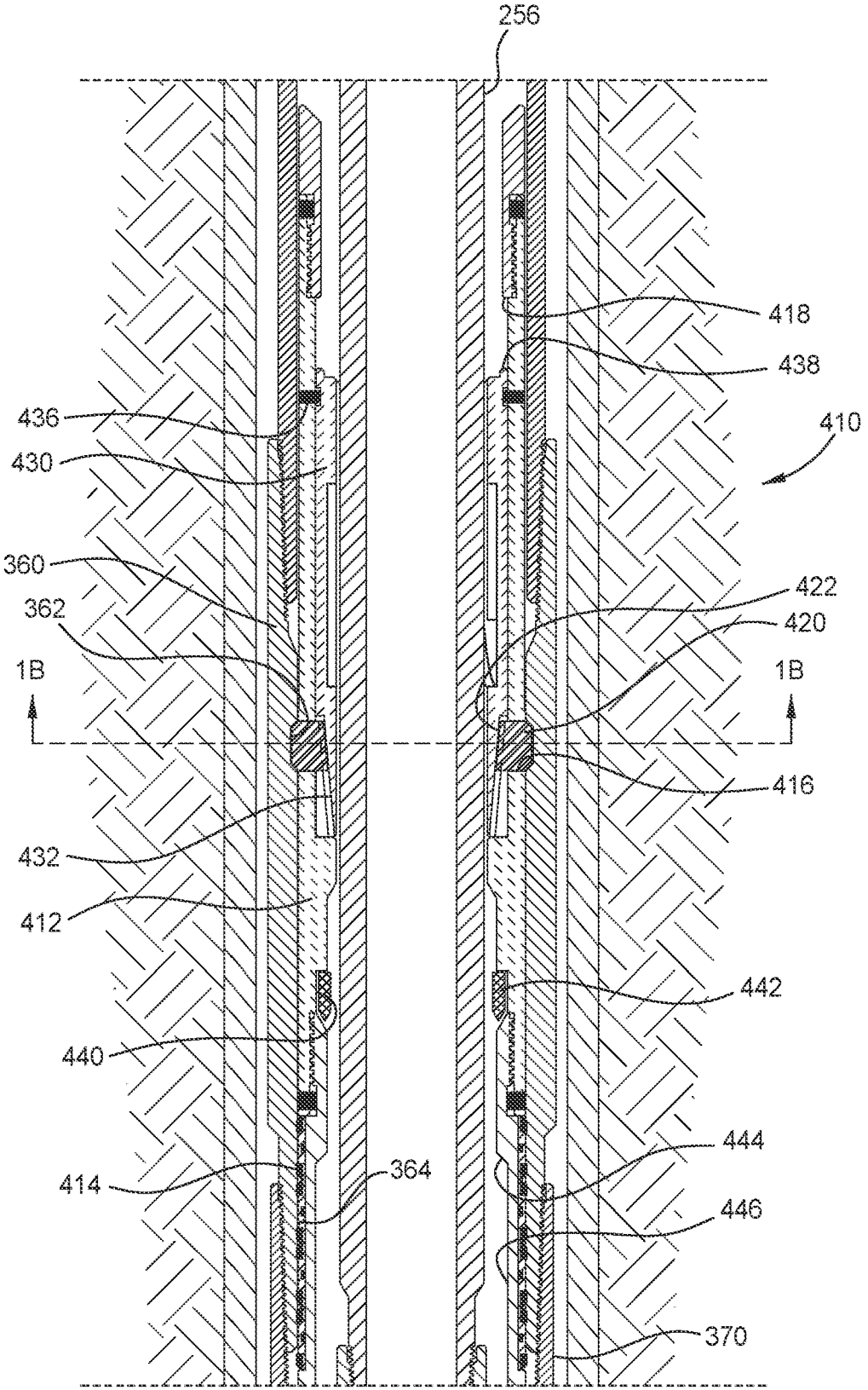
FIG. 1A provides a detailed view of a portion of the liner assembly and the isolation assembly depicted in FIG. 1.

FIG. 1A provides detailed view of a portion of the liner assembly 300 and the isolation assembly 400 depicted in FIG. 1. The isolator body 410 is secured within the locator sub 360. The isolator body 410 includes an isolator mandrel 412 with one or more seal elements 414 disposed therearound. The one or more seal elements 414 contact an inner surface 364 of the locator sub 360, and provide a seal between the locator sub 360 and the isolator body 410. One or more locking dogs 420 protrude through apertures 416 in the isolator mandrel 412, and engage with an internal recess 362 of the locator sub 360.

Figure 1B:
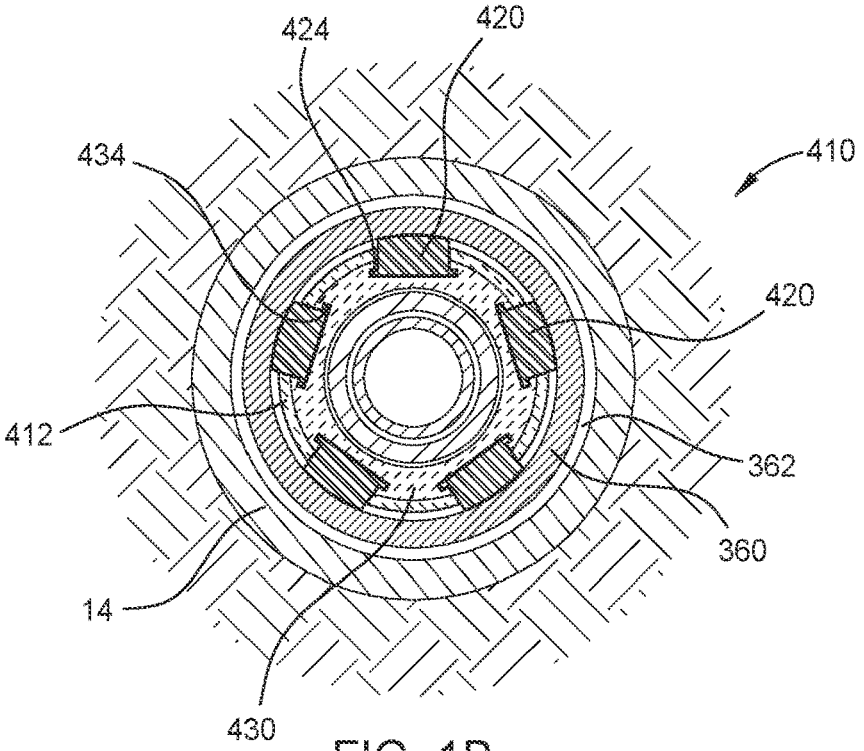
FIG. 1B provides a lateral cross-sectional view of a selected portion of the liner assembly and the isolation assembly depicted in FIG. 1A.

A sleeve 430 within the isolator mandrel 412 provides radial support to each locking dog 420. The sleeve 430 includes a slope 432 that interfaces with a corresponding slope 422 of each locking dog 420. As shown in the lateral cross-sectional view of FIG. 1B, each locking dog 420 includes a tab 424 positioned in a corresponding slot 434 of the sleeve 430. Interaction between the slope 422 and the slope 432, and between tab 424 and slot 434, facilitates radial extension and retraction of each locking dog 420 through each corresponding aperture 416 upon axial movement of the sleeve 430 with respect to the isolator mandrel 412. Returning to FIG. 1A, the sleeve 430 is at least temporarily retained in the position shown in the Figure by one or more fastener 436, such as a latch, locking dog, collet, C-ring, snap ring, shear ring, shear screw, shear pin, or the like. Upon defeat (such as by unlatching, unlocking, flexing, shearing, or the like) of the fastener 436, upward movement of the sleeve 430 is limited by interaction between an end 438 of the sleeve 430 and a shoulder 418 of the isolator mandrel 412.

A fastener 442 (such as a latch, locking dog, collet, C-ring, snap ring, shear ring, shear screw, shear pin, or the like) is disposed partially in a recess 440 within the isolator mandrel 412 for eventual securement of the isolation packer 460. Below the recess 440 is a downward-facing shoulder 444 and a seal bore 446.

Figure 1C:
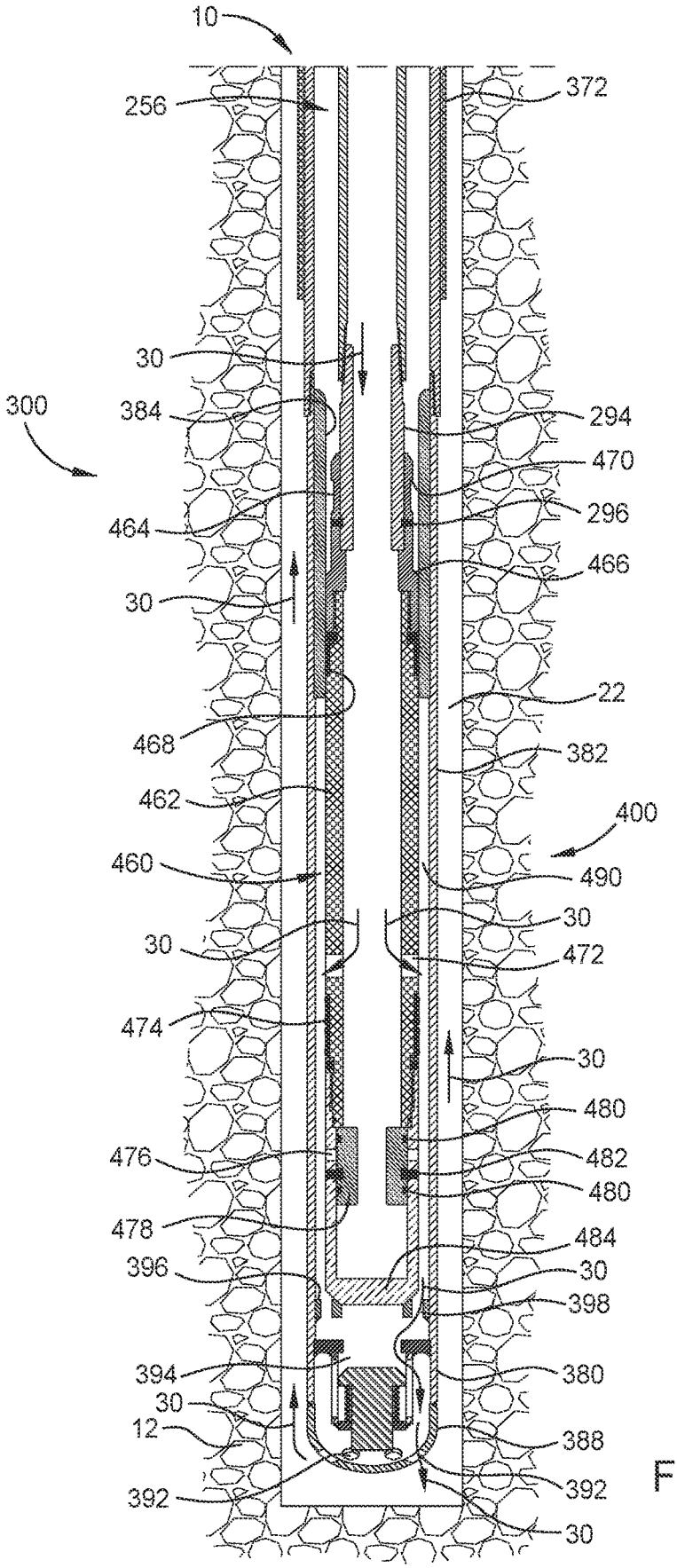
FIG. 1C provides a detailed view of a portion of the liner assembly and the isolation assembly depicted in FIG. 1.

FIG. 1C provides detailed view of another portion of the liner assembly 300 and the isolation assembly 400 depicted in FIG. 1. The liner 370, including sand control screen 372, is coupled to a circulating shoe 380 of the liner assembly 300. The circulating shoe 380 includes a tubular body 382 with an inner seal bore 384 at an upper end and a nose 388 at a lower end. Flow ports 392 are disposed in the nose 388. The circulating shoe 380 includes a one-way valve 394 at the lower end. The one-way valve 394 is configured to permit fluid flow from the tubular body 382 out of the flow ports 392, and inhibit fluid flow through the flow ports 392 into the tubular body 382. An inner shoulder 396 is disposed above the one-way valve 394. The inner shoulder 396 includes a fluid passage 398. The isolation packer 460 is disposed on the inner shoulder 396.

The isolation packer 460 includes a packer body 462 and a fishing neck 464. The fishing neck 464 is coupled to a tail pipe 294 of the inner string 256 by one or more fastener 296, such as a latch, locking dog, collet, C-ring, snap ring, shear ring, shear screw, shear pin, or the like. Upon defeat (such as by unlatching, unlocking, flexing, shearing, or the like) of the fastener 296, the inner string 256 may be separated from the isolation packer 460.

The fishing neck 464 includes an external downward-facing shoulder 470. An upward-facing shoulder 466 is located below the fishing neck 464. Upper seal element 468 is disposed around the packer body 462 and makes sealing contact with the inner seal bore 384 of the circulating shoe 380. One or more circulation ports 472 facilitate fluid communication between the interior and exterior of the packer body 462. Lower seal element 474 is disposed around the packer body 462. As shown in the Figure, when the isolation packer 460 is installed in the circulating shoe 380, the lower seal element 474 is not in sealing contact with the circulating shoe 380.

One or more dump ports 476 below the lower seal element 474 facilitate fluid communication between the interior and exterior of the packer body 462. A sleeve 478 within the packer body 462 at least temporarily obscures the one or more dump ports 476. The sleeve 478, together with seals 480, inhibit fluid passage through the one or more dump ports 476. The sleeve 478 is temporarily held in the illustrated blocking position by one or more fastener 482, such as a latch, locking dog, collet, C-ring, snap ring, shear ring, shear screw, shear pin, or the like. A nose 484 at the bottom of the isolation packer 460 blocks fluid communication between the interior and exterior of the packer body 462.

Operations

In some embodiments, it is contemplated that deployment of the liner assembly 300 into the wellbore 10 may involve circulating a fluid through the work string 16 and the inner string 256. The fluid may include a drilling fluid. Additionally, or alternatively, the fluid may include a brine. The fluid passes in a circulation path denoted by arrows 30 in FIG. 1C. The fluid passes through the tail pipe 294 of the inner string 256 and into the isolation packer 460. The fluid then passes through the circulation port(s) 472 of the isolation packer 460 and into the annular space 490 between the isolation packer 460 and the tubular body 382 of the circulating shoe 380. The upper seal element 468 engaged with the inner seal bore 384 of the tubular body 382 prevents the fluid from entering the liner 370 from the circulating shoe 380. Instead, the fluid passes via the fluid passage 398 of the inner shoulder 396 of the circulating shoe 380, the one way valve 394, and the flow ports 392 in the nose 388 into the annulus 22. The fluid then passes up through the annulus 22 and out of the wellbore 10.

Figure 2:
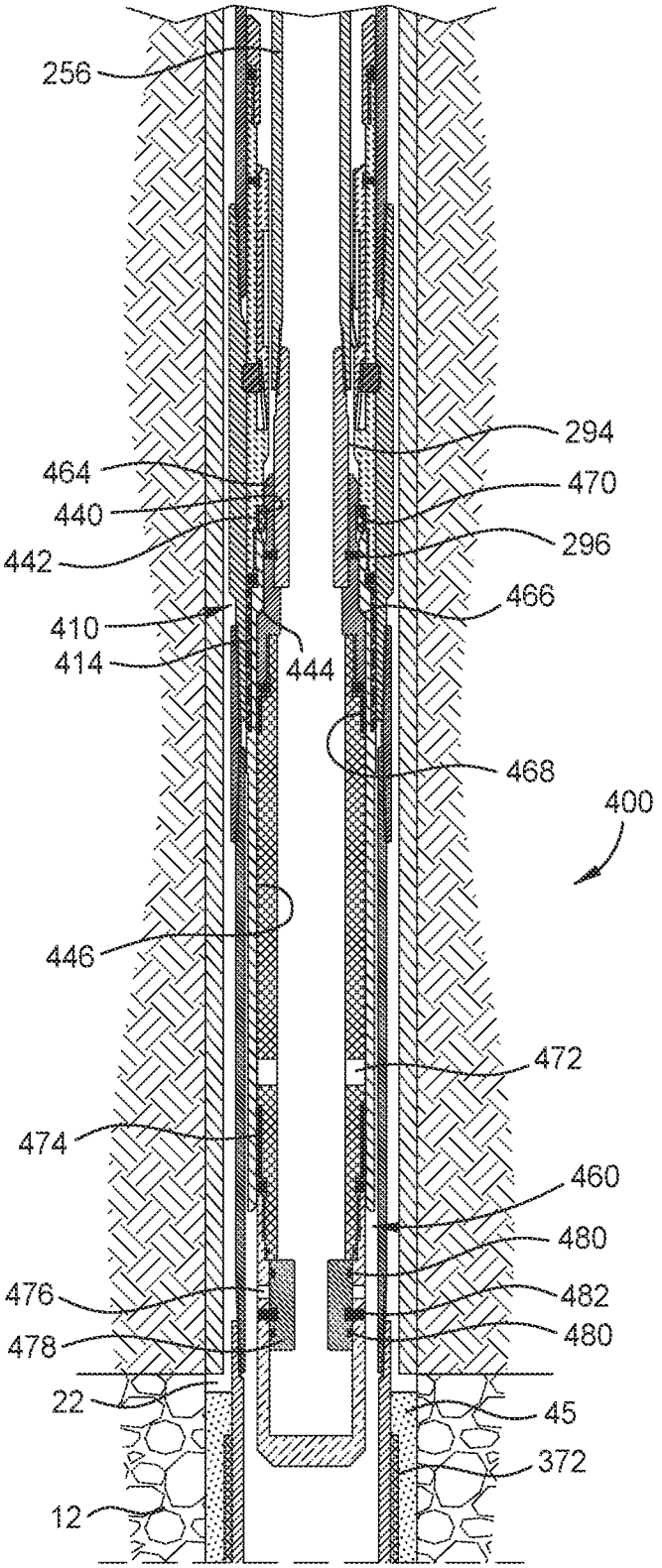
FIG. 2 provides a longitudinal cross-sectional view of a portion of the liner assembly and the isolation assembly depicted in FIG. 1 during an operation in the wellbore.

In some embodiments, it is contemplated that subsequent operations may include forming a gravel pack around the liner 370 in the annulus 22, such as gravel pack shown in FIG. 2. In some embodiments, the operation of forming a gravel pack may be omitted. In some embodiments, it is contemplated that subsequent operations may include placing a cement slurry around the liner 370 in the annulus 22. In some embodiments, the operation of placing a cement slurry around the liner 370 may be omitted. It is further contemplated that subsequent operations may include setting the packer 310 (and/or the liner hanger, if present), and thereafter uncoupling the liner running sub 240 from the packer 310 (or from the liner hanger, if present).

FIG. 2 illustrates a portion of the liner assembly 300 and the isolation assembly 400 depicted in FIG. 1 during a subsequent operation after uncoupling the liner running sub 240 from the packer 310 (or from the liner hanger, if present). The work string 16 is manipulated to pull the inner string 256 upwards. Upward movement of the inner string 256 raises the isolation packer 460 out of the circulating shoe 380. Upward movement of the inner string 256 brings the isolation packer 460 into engagement with the isolator body 410. The isolation packer 460 enters the isolator mandrel 412.

The fishing neck 464 of the isolation packer 460 interacts with the fastener 442 of the isolator body 410. For example, in embodiments in which the fastener 442 is a latch, locking dog, collet, C-ring, snap ring, or another type of flexible member, the fishing neck is raised past the fastener 442 to displace the fastener 442 radially outwards. After the external shoulder 470 has moved past the fastener 442, the fastener 442 moves back towards the position shown in FIG. 2 (for example under a biasing force, such as elastic return of the material of the fastener 442 itself).

In some embodiments, the fastener 442 is initially disposed on the isolation packer 460 instead of within the isolator body 410. In such embodiments, upward movement of the isolation packer 460 within the isolator body 410 brings the fastener 442 into engagement with the recess 440 in the isolator mandrel 412.

The external shoulder 470 on the fishing neck 464 is sized such that the external shoulder 470 can rest on the fastener 442 of the isolator body, thereby securing the isolation packer 460 to the isolator body 410. When the isolation packer 460 is secured to the isolator body 410, the weight of the isolation packer 460 is transferred to the isolator mandrel 412 via the fastener 442. When the isolation packer 460 is secured to the isolator body 410, the upper seal element 468 and lower seal element 474 of the isolation packer 460 are in sealing engagement with the seal bore 446 of the isolator body 410. Fluid communication through the circulation port(s) 472 of the isolation packer 460 is thus inhibited.

Figure 3:
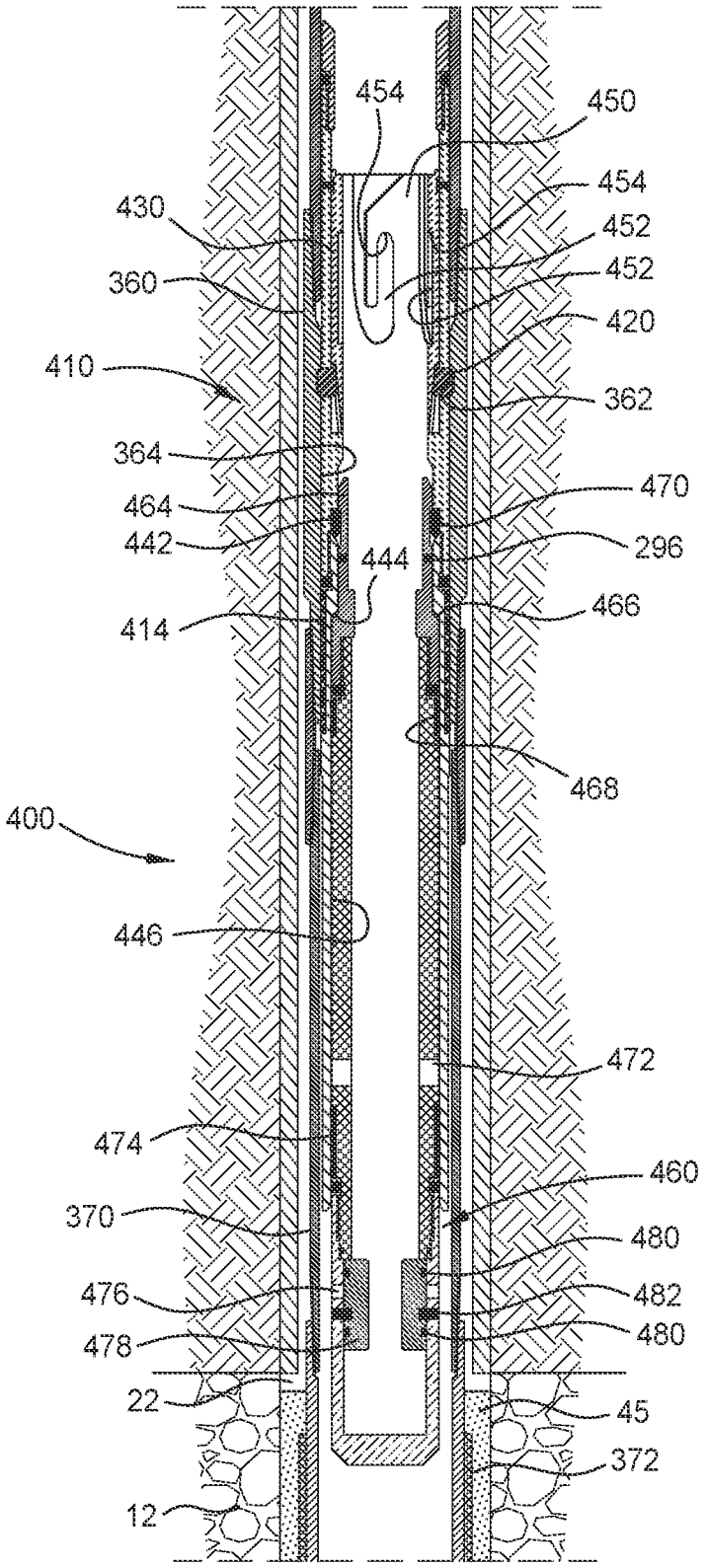
FIG. 3 provides a longitudinal cross-sectional view of a portion of the liner assembly and the isolation assembly depicted in FIG. 1 during a subsequent operation in the wellbore.

FIG. 3 illustrates a portion of the liner assembly 300 and the isolation assembly 400 during a subsequent operation after engaging the isolation packer 460 with the isolator body 410. Upward movement of the isolator body 410 is prevented by engagement of the one or more locking dogs 420 with the internal recess 362 of the locator sub 360. Upward movement of the isolation packer 460 with respect to the isolator body 410 is prevented by engagement of the shoulder 466 of the isolation packer 460 with the corresponding shoulder 444 of the isolator body 410. With the isolation packer 460 secured to the isolator body 410, further upward movement of the inner string 256 results in the defeat (such as by unlatching, unlocking, flexing, shearing, or the like) of the fastener 296 that couples the fishing neck 464 of the isolation packer 460 to the tail pipe 294 of the inner string 256. The work string 16, liner running sub 240, and inner string 256 are then retrieved from the wellbore 10. The sleeve 430 includes a retrieval profile, such as J-slot 450, which is visible in FIG. 3. Other forms of retrieval profile are also contemplated. The retrieval profile is utilized during subsequent retrieval of the isolation assembly 400 from the wellbore 10.

In the configuration shown in FIG. 3, the isolation assembly 400 provides a barrier to fluid communication within the liner assembly 300 between the packer 310 and the liner 370 that is below the isolation assembly 400. Fluid communication between the locator sub 360 and the isolator body 410 is inhibited by the seal element 414 on the isolator body 410 bearing against the inner surface 364 of the locator sub 360. Fluid communication between the isolator body 410 and the isolation packer 460 is inhibited by the upper seal element 468 of the isolation packer 460 bearing against the seal bore 446 of the isolator body 410. Fluid communication to or from the liner 370 extending below the isolation assembly 400 through the circulation port(s) 472 of the isolation packer 460 is inhibited by the lower seal element 474 of the isolation packer 460 bearing against the seal bore 446 of the isolator body 410. Fluid communication to or from the liner 370 extending below the isolation assembly 400 through the dump port(s) 476 of the isolation packer 460 is inhibited by the sleeve 478 and seals 480.

Figure 4A:
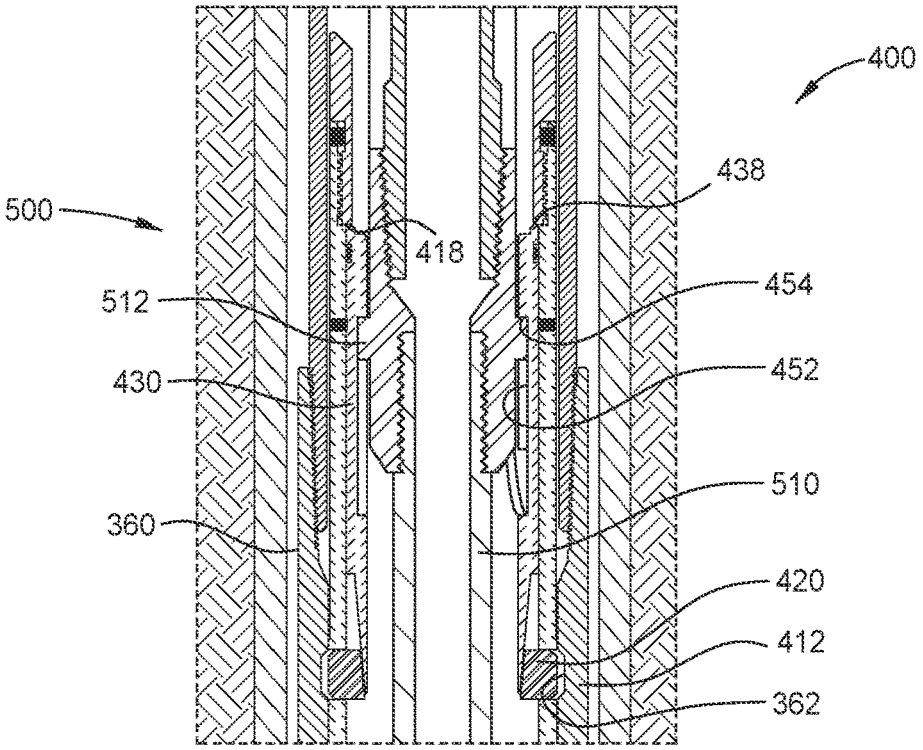
FIG. 4A provides a detailed view of a portion of the liner assembly and the isolation assembly depicted in FIG. 4.
Figure 4:
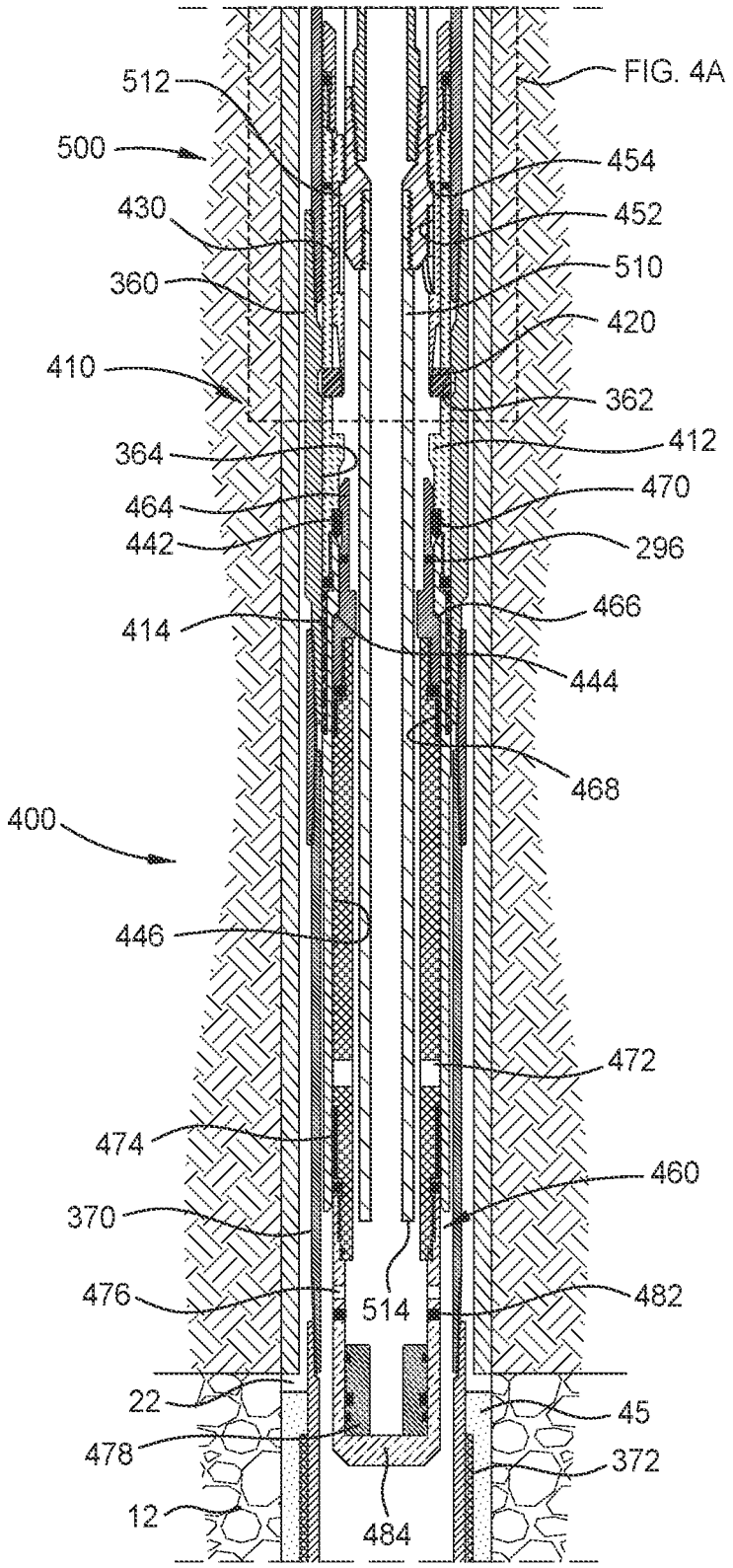
FIG. 4 provides a longitudinal cross-sectional view of a portion of the liner assembly and the isolation assembly depicted in FIG. 1 during a subsequent operation in the wellbore.

FIG. 4 illustrates the portion of the liner assembly 300 and the isolation assembly 400 depicted in FIG. 3 during a subsequent operation in the wellbore. FIG. 4A shows a detailed view of a portion of FIG. 4. A retrieval tool 500 is deployed into the wellbore 10. It is contemplated that the retrieval tool 500 may be deployed using a work string, such as work string 16, or using wireline or slickline or the like. The retrieval tool 500 includes a mandrel 510 and one or more outwardly projecting lugs 512. The mandrel 510 is sized to fit within the isolation packer 460.

Downward movement of the retrieval tool 500 brings a lower end 514 of the retrieval tool 500 into engagement with the sleeve 478 covering the dump port(s) 476. The impact and/or force applied by the lower end 514 of the retrieval tool 500 against the sleeve 478 defeats the fastener 482 (such as by unlatching, unlocking, flexing, shearing, or the like), and causes downward movement of the sleeve 478 to uncover the dump port(s) 476.

During the downward motion of the retrieval tool 500 within the isolation packer 460, the one or more lugs 512 interact with the J-slot 450 such that each lug 512 moves within a corresponding track 452 of the J-slot 450. Subsequent upward movement of the retrieval tool 500 with respect to the isolation assembly 400 brings each lug 512 into engagement with a corresponding end 454 of each track 452 of the J-slot 450. Thereafter, an upward force applied to the retrieval tool 500 causes each lug 512 to apply an upward force to the sleeve 430 via the J-slot 450.

The isolator mandrel 412 is initially restrained from moving upwards by the interaction between the one or more locking dogs 420 with the internal recess 362 of the locator sub 360. When the upward force applied to the sleeve 430 reaches a threshold value, the fastener 436 is defeated (such as by unlatching, unlocking, flexing, shearing, or the like), and the sleeve 430 moves upward with respect to the isolator mandrel 412. The sleeve 430 moves upward also with respect to the one or more locking dogs 420. Each slot 434 in the sleeve 430 interacts with a corresponding tab 424 of a corresponding locking dog 420, causing each locking dog 420 to move radially inward and out of engagement with the internal recess 362 of the locator sub 360.

The end 438 of the sleeve 430 then engages the shoulder 418 of the isolator mandrel 412. The weight of the isolation assembly 400 is borne by the retrieval tool 500 via the engagement of each lug 512 with each corresponding end 454 of each track 452 of the J-slot 450 of the sleeve 430, and the engagement of the end 438 of the sleeve 430 with the shoulder 418 of the isolator mandrel 412.

The isolation assembly 400 is then retrieved from the wellbore 10. During retrieval of the isolation assembly 400, fluid within the work string and/or within the retrieval tool 500 and/or the isolation packer 460 can drain through the dump port(s) 476.

Embodiments of the present disclosure provide for the running of an isolation assembly into a wellbore along with a tubular, such as a liner or a casing string, and the establishment of a barrier within the tubular in a single trip into the wellbore. The use of one or more locking dogs to secure the isolation assembly to the tubular facilitates the establishment, and subsequent removal, of the barrier without using other anchoring devices, such as slips, that would damage the internal surface of the tubular.

While the foregoing is directed to embodiments of the present disclosure, other and further embodiments of the disclosure may be devised without departing from the basic scope thereof, and the scope thereof is determined by the claims that follow.

What is claimed is:

1. A method of running an operation in a wellbore extending through a subterranean formation, the method comprising:

running a workstring into the wellbore, the workstring having a tubular, an inner string extending through the liner, and an isolation packer attached to the inner string;

positioning the tubular at a selected location in the wellbore adjacent the subterranean formation;

detaching the tubular from the workstring;

pulling the inner string upwards in the wellbore;

positioning the isolation packer at the upper end of the tubular;

fastening the isolation packer to the upper end of the tubular;

sealing against flow across the isolation packer;

detaching the isolation packer from the inner string; and pulling the inner string from the wellbore.

2. The method of claim 1, further comprising circulating a fluid through the workstring, the inner string, and the annulus between the tubular and the wellbore.

3. The method of claim 2, wherein circulating a fluid further comprises: flowing the fluid along an inner bore defined in the isolation packer and through radial ports defined in the isolation packer.

4. The method of claim 2, wherein the fluid is cementing fluid and further comprising cementing the tubular in the wellbore.

5. The method of claim 2, wherein the tubular further includes sand screens and circulating the fluid further includes gravel packing the annulus between the wellbore and the sand screens.

6. The method of claim 1, further comprising sealing the annulus between the tubular and the wellbore.

7. The method of claim 6, wherein the workstring further includes an annular packer or liner hanger, and wherein sealing the annulus between the liner and the wellbore further comprises setting the annular packer or liner hanger in the wellbore.

8. The method of claim 1, wherein the workstring further comprises a shoe positioned at the lower end of the tubular, the shoe having ports allowing fluid flow between the shoe and the wellbore annulus.

9. The method of claim 1, wherein detaching the tubular from the workstring further comprises detaching the tubular from the inner string.

10. The method of claim 1, wherein the workstring further includes a tubular mandrel positioned within the tubular, detachably coupled to the tubular, and sealingly engaged with the tubular to prevent flow along an annulus defined between the tubular mandrel and the tubular; and wherein fastening the isolation packer to the tubular further comprises: pulling the isolation packer into the tubular mandrel, fastening the isolation packer to the tubular mandrel, and sealingly engaging the isolation packer with the tubular mandrel to prevent fluid flow along an annulus between the tubular mandrel and the isolation packer.

11. The method of claim 3, wherein sealing against flow across the isolation packer further comprises sealing against flow through the radial ports of the isolation packer.

12. The method of claim 10, wherein sealing against flow across the isolation packer further comprises blocking flow through radial ports defined in the isolation packer with the tubular mandrel.

13. The method of claim 1, wherein detaching the isolation packer from the inner string further comprises defeating one or more fasteners coupling the isolation packer to the inner string.

14. The method of claim 1, further comprising removing the isolation packer from the wellbore.

15. The method of claim 10, further comprising removing the isolation packer and the tubular mandrel from the wellbore.

16. The method of claim 15, further comprising running in a retrieval tool, attaching the retrieval tool to the isolation packer, pulling upwards on the isolation packer, uncoupling the tubular mandrel from the tubular, and pulling out the isolation packer and the tubular mandrel.

17. The method of claim 16, wherein uncoupling the tubular mandrel from the tubular comprises: coupling the retrieval tool to a sliding sleeve positioned in the tubular mandrel, locking dogs protruding through radial openings in the mandrel and engaging cooperating internal recesses defined in the tubular, and pulling the sliding sleeve upwards thereby releasing the locking dogs from the recesses of the tubular.

18. The method of claim 16, further comprising, using the retrieval tool, sliding a dump port sleeve to unseal dump ports defined through the isolation packer, thereby allowing fluid flow between the isolation packer and the wellbore.

* * * * *